US005810637A

United States Patent [19]

Mileti

[11] Patent Number: 5,810,637

[45] Date of Patent: Sep. 22, 1998

[54] COMPACT THROWING TOY WITH COLLAPSED TAIL

[75] Inventor: Robert J. Mileti, Torrington, Conn.

[73] Assignee: Trlby Innovative LLC, Torrington, Conn.

[21] Appl. No.: 255,076

[22] Filed: Jun. 7, 1994

Related U.S. Application Data

[63] Continuation-in-part of Ser. No. 18,839, Feb. 18, 1993, abandoned.

[51] Int. Cl.[6] ..... A63H 27/00

[52] U.S. Cl. ..... 446/61; 446/34

[58] Field of Search ..... 446/34, 61, 46; 273/424, 425, 428; 244/153 R, 153 A; 40/214, 215, 477; 116/265, 264, 173; 73/170.05

[56] References Cited

U.S. PATENT DOCUMENTS

| | | | |
|---|---|---|---|
| 1,968,838 | 8/1934 | Lanagan . | |
| 3,264,776 | 8/1966 | Morrow | 446/34 |
| 4,151,674 | 5/1979 | Klahn et al. | 446/34 |
| 4,246,721 | 1/1981 | Bowers | 446/34 |
| 4,290,226 | 9/1981 | Stauffer | 446/46 |
| 4,345,401 | 8/1982 | Brzack | 446/61 X |
| 4,390,148 | 6/1983 | Cudmore | 446/34 X |
| 4,558,862 | 12/1985 | Kelly . | |
| 4,624,648 | 11/1986 | Waters | 446/176 |
| 4,790,788 | 12/1988 | Hill | 446/61 |
| 4,850,798 | 7/1989 | Bailey | 416/11 |
| 4,850,923 | 7/1989 | Etheridge | 446/34 |
| 5,112,061 | 5/1992 | Lamle | 273/428 X |
| 5,118,054 | 6/1992 | Kirschenbaum et al. | 446/34 X |

*Primary Examiner*—Robert A. Hafer
*Assistant Examiner*—Jeffrey D. Carlson
*Attorney, Agent, or Firm*—St. Onge Steward Johnston & Reens, LLC

[57] ABSTRACT

The throwing toy of the present invention can generally be described as a two part toy having a forward portion and a trailing portion, where the forward portion utilizes a substantially rigid, ring-like structure in which the center of gravity of the toy is located and the trailing portion is made of a collapsible cylindrical tail which extends from the forward portion and has a length of at least about two times the axial length of the forward portion.

9 Claims, 2 Drawing Sheets

COMPACT THROWING TOY WITH COLLAPSED TAIL

RELATED APPLICATION

This application is a continuation in part of application Ser. No. 08/018,839 filed Feb. 18, 1993, now abandoned.

1. Technical Field

The present invention relates to a throwing toy having sufficient aerodynamic properties to permit throwing of the toy for relatively long distances. In addition, the inventive throwing toy can be easily collapsed for storage and transport, which facilitates use as an inexpensive premium item.

Throwing toys have become attractive consumer items for use by children and adults alike. They can be used by individuals in games involving throwing the toy and determining the greatest distance it can be thrown, and it can be used by groups for the same purpose or for throwing back and forth or for variety of other games involving throwing distance and/or accuracy. Because of the wide variety of applications of aerodynamic throwing toys, which physically differ from balls and other like objects of which the consumer has become accustomed, they are highly desirable and commercially effective.

What is desired is a throwing toy that differs in appearance from previous aerodynamic throwing toys, which are light weight and relatively simple in both manufacture and use. It is also desirable to produce a toy that can be packaged in a small compact form and which can be sold or given away as an inexpensive premium item.

2. Background Art

The prior art is replete with different types of throwing toys. Examples include the aerial toy of Morrow, disclosed in U.S. Pat. No. 3,264,776, which is a hollow tube with both a leading and trailing end such that the center of gravity is located within the leading end of the tube. Also in this category is the flying cylinder of Klahn and Upham described in U.S. Pat. No. 4,151,674 and which is generally a hollow cylinder made from two pieces of thin sheet material, a leading end having an outwardly and rearwardly directed curl. Similarly, Hill, in U.S. Pat. No. 4,790,788, discloses an aerial toy having a leading edge and a trailing edge with a flexible, resilient, thin wall sail or aid foil extending forward from the trailing edge; and Etheridge describes a flying toy having a hollow cylinder with an annular side wall having an air foil shape in U.S. Pat. No. 4,850,923. U.S. Pat. No. 4,624,648 discloses a rotary aerial toy that functions as a wind sock that rotates, but this patent does not relate to a throwing toy. Other flying toys are disclosed in U.S. Pat. No. 4,246,721, U.S. Pat. No. 4,290,226 and U.S. Pat. No. 4,390,148.

Unfortunately, none of the throwing toy designs of the prior art provide both the aerodynamic properties and ease of manufacture and use of the throwing toy of the present invention. Further, prior art throwing toy designs are difficult to package in a suitably compact form.

SUMMARY AND INVENTION

The throwing toy of the present invention can generally be described as a two part toy having a forward portion and a trailing portion. The forward portion utilizes a substantially rigid, ring-like structure in which locates the center of gravity of the toy in the forward portion of the toy. The ring-like structure which makes up the forward portion advantageously comprises a rigid high density plastic ring such as a ring made of polyvinyl chloride (PVC), high density polyethylene, or high density polypropylene.

The trailing portion of the throwing toy is made of a collapsible cylindrical tail which extends from the forward portion and has a length of at least about two, more preferably at least about four, times that of the forward portion. The trailing portion is made of a thin, flexible material. The trailing portion is in a collapsed state when it is not airborne, and fills with an airstream when it is thrown. The pressure of the airstream forces the cylindrical wall of the trailing portion radially outwardly and maintains the trailing portion in a tubular shape during flight. Once the throwing toy lands, the cylindrical tail is no longer supported by the airflow and collapses under its own weight.

Generally, the trailing portion is secured to the forward portion by adhesive or by other suitable means which would be apparent to the skilled artisan, such as by heat seal. The trailing portion can be secured to the forward portion by either securing the inner surface of an end of the trailing portion to the outer surface of the forward portion or, although less desirable, by securing the outer portion of an end of the trailing portion to the inner surface of the forward portion.

In accordance with one aspect of the invention, the substantially rigid ring structure is formed with inner and outer concentric rings that are retained together by a fastener. The cylindrical tail has a front margin that is placed between the inner and outer rings prior to assembly. When the rings are assembled into a concentric relationship, the front margin of the tail is held between the rings.

Additional advantages of a throwing toy in accordance with the present invention will be apparent from the following detailed description of the invention with reference to the drawings.

DESCRIPTION OF THE DRAWINGS

The invention will be better understood and its advantages will become more apparent from the following detailed description, especially when read in light of the attached drawings, wherein.

DETAILED DESCRIPTION OF THE PREFERRED EMBODIMENT

Figure 1:
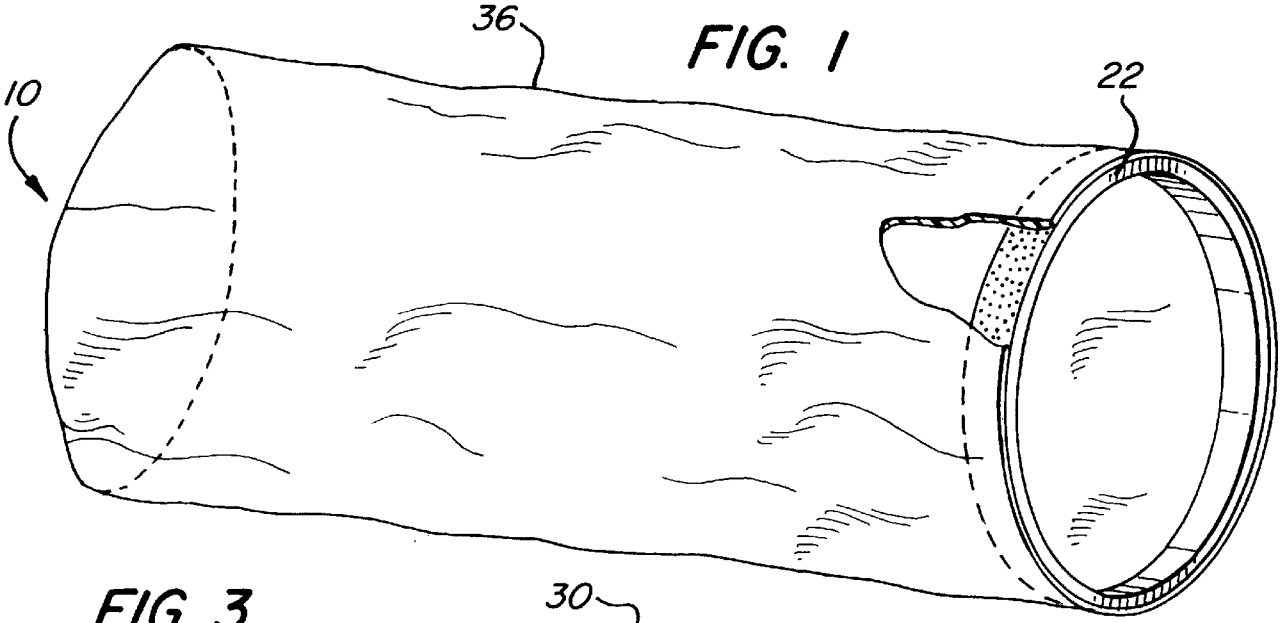
FIG. 1 is a partially broken away isometric view of the throwing toy of the present invention.
Figure 3:
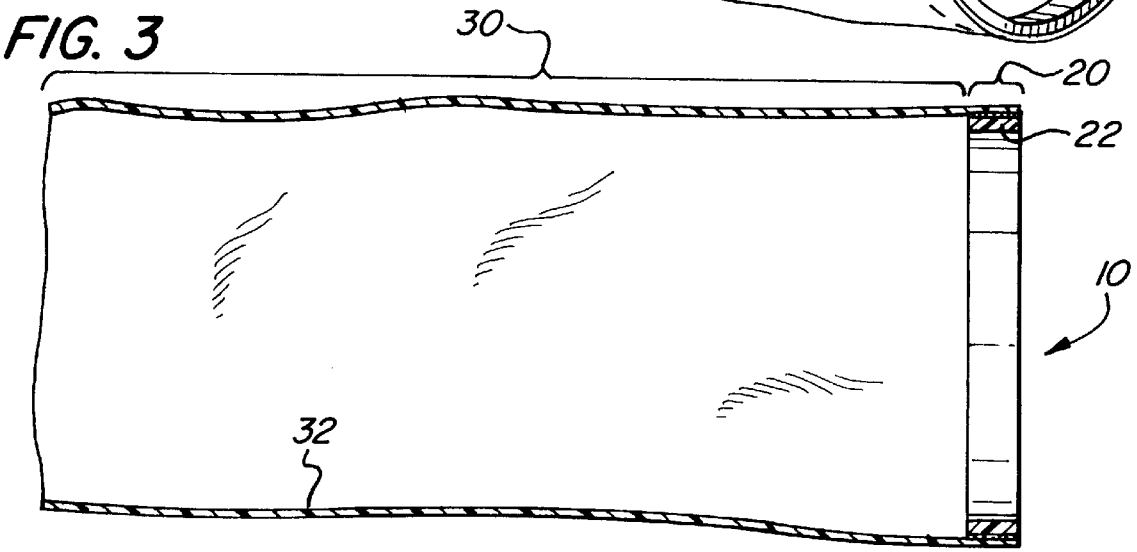
FIG. 3 is a side cross-sectional view of the throwing toy of FIG. 2 taken along lines 3—3.
Figure 2:
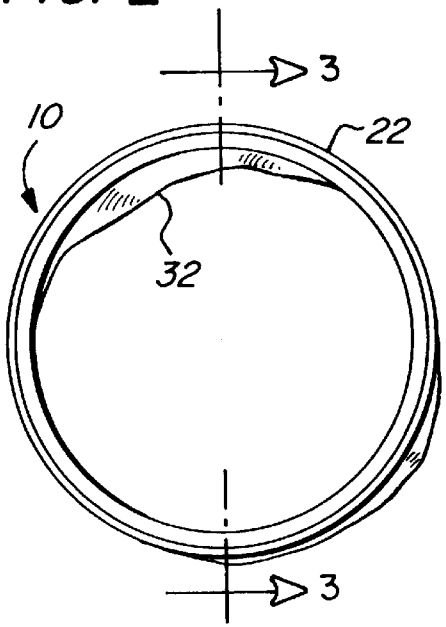
FIG. 2 is a forward plan view of the throwing toy of FIG. 1.

Referring to the drawings, a throwing toy in accordance with the invention is generally indicated by the reference numeral 10. The terms "top", "bottom", "front", and "rear" refer to the orientation illustrated in The Figures. It will be understood, though, that the illustrated orientations are not necessary for operability of the throwing toy 10.

Referring now to FIGS. 1–4, throwing toy 10 generally comprises a forward portion 20, comprising a rigid, ring-like structure 22 which preferably comprises a rigid high density plastic ring. Although ring-like structure 22 should be as round as possible, perfect roundness is not critical, but should be approximated as closely as possible. In addition, the rigidity of ring-like structure 22 should be sufficient to maintain dimensional stability of forward portion 20 through normal handling and when forward portion 20 is exposed to the forces it is expected to encounter during throwing and landing as well as striking of solid objects such as walls. However, the ring-like structure may have some flexibility to reduce the likelihood of damage to the toy on landing or injury to a person hit by the toy.

Ring-like structure 22 should have a diameter which varies between the approximate diameter of a baseball and that of a softball in order to create a comfortable or familiar feeling for the user. Preferably, ring-like structure 22 has a diameter which varies between about 2½ inches and about 4 inches, more preferably between about 3 inches and about 3½ inches. In addition, and again to facilitate comfortable and familiar handling of throwing toy 10, ring-like structure 22 should have a width (that is, a front of rear length) sufficient to enable the user to comfortably grip ring-like structure 22 for throwing. The width of ring-like structure 22 should vary between about 0.25 inches and about 0.75 inches, more preferably between about 0.30 inches to about 0.45 inches.

Throwing toy 10 further comprises a trailing portion 30 which extends rearwardly from forward portion 20. Trailing portion 30 comprises a collapsible cylindrical tail 32. Most preferably, tail 32 is relatively flexible and should be non-dimensionally stable. As noted above, non-dimensionally stable refers to the property of tail 32 wherein it can be readily deformed and, most preferably, after deformation by wind or other forces, tail 32 will not automatically assume its original shape. This characteristic is generally provided by forming trailing portion 30 with a thin (i.e., about 1 mil to about 8 mils) sheet of plastic material such as polyvinyl chloride, polyethylene and polypropylene.

When the throwing toy is launched through the air, speed is imparted to the toy and creates airflow past the toy. The speed creates airflow through the opening of the ring-like structure. The airflow forces the collapsed tail radially outwardly into a generally tubular shape. The tubular shape is maintained during flight of the toy by the air pressure generated by the airflow. Once the toy lands the tail is collapsed by its own weight because the tail is no longer supported by the airflow.

During flight, the airflow forces the collapsed into a generally tubular shape. However, it should be understood that because the plastic material is very thin and flexible, it is subject to variations created by flight variables such as speed of the toy, wind and updrafts and downdrafts. More particularly, as the toy is flown, the tubular shape can fluctuate which in turn causes the throwing toy to move in an atheistically interesting fashion. In addition, since the trailing portion is collapsed, the toy can be gripped by the end of the trailing portion. More specifically, a person seeking to launch the toy by hand, rather than holding the ring-like structure, may alternatively hold on to the end of the tail and throw the toy by slinging the tail. When a sling is launched, a rock or other heavy object is placed in a pouch which is released after substantial speed has been generated. The ring like structure, because it is much heavier than the trailing portion acts as this heavy weight relative to the tail. When a person slings the ring-like structure and releases the tail at the last moment, substantial speed is imparted to the ring-like structure and the tail immediately fills to its tubular shape upon release. Thus, a small child can impart substantial speed to the ring-like structure simply by slinging it.

In order to provide sufficient aerodynamic properties to throwing toy 10, trailing portion 30 should extend from forward portion 20 by at least about two times and more preferably at least about four times the width of forward portion 20. In a more advantageous embodiment of throwing toy 10, trailing portion 30 extends from forward portion 20 by at least about ten times, and most advantageously at least about twenty times the width of forward portion 30.

For instance, if ring-like structure 22 has a width of about 0.40 inches, trailing portion 30 should preferably extend from forward portion 20 by at lest about 4 inches and most preferably by at least about 8 inches. In addition, the relative weight of forward portion 20 and trailing portion 30 should be such that the center of gravity of throwing toy 10 lies within forward portion 20.

To prepare throwing toy 10, ring-like structure 22 and cylindrical tail 32 are each independently provided and tail 32 secured to ring-like structure 22 by a suitable adhesive, such as glue, tape, etc.; or by other physical means such as staples, tacks, heat seal, etc. Tail 32 can be secured to ring-like structure 22 such that the outer surface of an end of tail 22 is secured to the inner diameter of ring-like structure 22 or, more preferably, so that the inner surface of tail 32 is secured to the outer diameter of ring-like structure 22.

In operation, throwing toy 10 can also be used by grasping it about ring-like structure 22 and throwing toy 10 such that forward portion 20 is the leading edge. This is an alternative to slinging the toy. The opening in ring-like structure 22 receives airflow, which then proceeds axially through trailing portion 30. In order to provide for aerodynamic activity, throwing toy may be spun while being thrown to provide sufficient lift and carry for a relatively long distance throw, although spinning of throwing toy 10 is not necessary for operability.

When not in use, the collapsibility of trailing portion 30 permits the user to fold or otherwise compress throwing toy 10 into a relatively small package. This facilitates easy transport and storage. This characteristic also makes throwing toy 10 uniquely effective for use as a premium item, for inclusion in, for instance, cereal boxes, cigarette cartons and other packaging.

Figure 6:
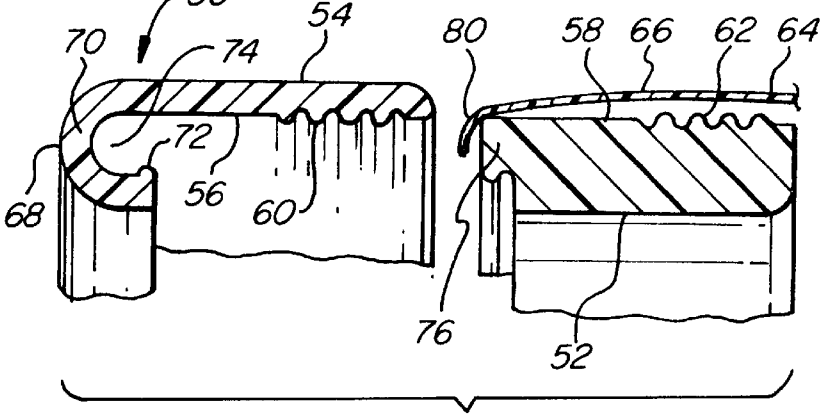
FIG. 6 is a sectional view of the toy shown in FIG. 5 prior to assembly.
Figure 5:
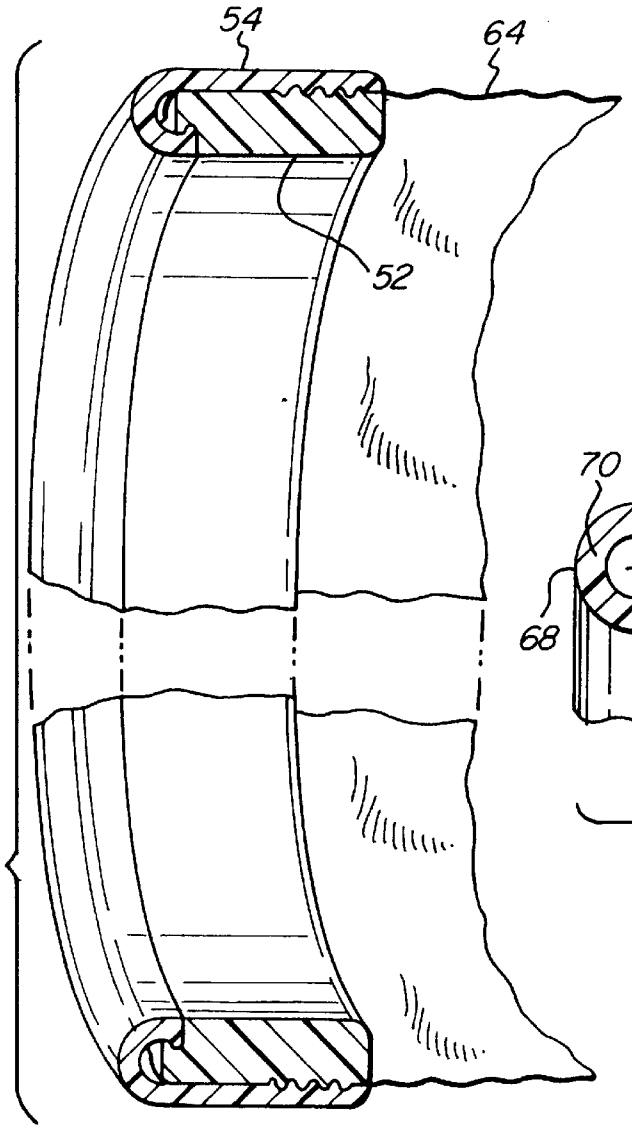
FIG. 5 is a section view of another embodiment of the throwing toy in an assembled condition.
Figure 4:
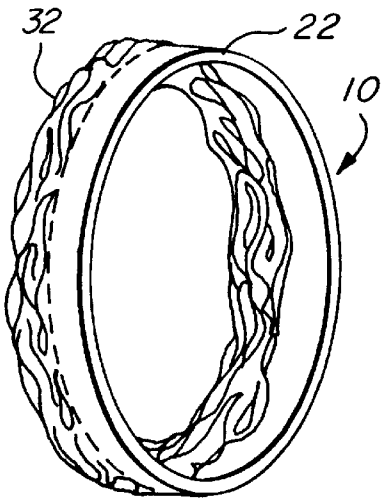
FIG. 4 is an isometric view of the throwing toy of FIG. 1 shown in its collapsed form.

Referring to FIGS. 5 and 6, an alternate embodiment of the throwing toy is shown. The throwing toy 50 functions identically to the throwing toy previously described. However, the use of inner and outer rings permits the tail to be attached mechanically. More specifically, referring to FIGS. 5 and 6, the toy 50 includes an inner ring 52 and an outer ring 54. The inner and outer rings are located in the centric relation when they are assembled as shown in FIGS. 5.

Referring to FIG. 6, the details of the inner and outer rings will now be described. The outer ring 54 has an interior surface 56. The inner ring 52 has an outer surface 58. Both surfaces 56 and 58 have a generally cylindrical shape. When the rings are assembled, the surfaces 56 and 58 are in face-to-face relation. Surface 56 includes a series of undulations 60. Likewise, surface 58 includes a series of undulations 62. The undulations 60 and 62 are in mating relationship such that when the rings 52 and 54 are assembled in concentric relationship, the undulations mate to firmly retain cylindrical tail 64. More specifically, cylindrical tail 64 includes a front margin 66 that is placed over inner ring 52. When the inner and outer rings are assembled as shown by the arrows in FIG. 6, the front margin 66 of the tail 64 is sandwiched between the inner and outer ring, and held firmly in position by the undulations 60 and 62.

Referring to FIG. 6, the outer ring 54 has a front edge 68 that is formed by an arcuate turn 70 in the body of ring 54. The arcuate turn terminates in an annular hook 72. The arcuate turn 70 forms a cavity 74 for receiving the front portion 76 of the inner ring 52. The front portion 76 of the inner ring 52 includes an annular groove 78 for receiving the annular hook 72 of the outer ring 54. Preferably, the front margin 66 of the tail 64 is placed in a position so that the very front edge 80 overlaps the end of the ring and is retained within cavity 74 of the outer ring. In accordance of one aspect of the invention, the inner surface 56 and the outer surface 58 may include a slight taper to facilitate assembly.

The flying toy described in FIGS. 5 and 6 has certain advantages in assembly. More specifically, the inner ring 52 and the outer ring 54 are each preferably formed in a single molding operation. The tail 64 is formed in a separate operation, and all three parts may be shipped to the ultimate customer in an unassembled form. Since the throwing toy may have uses in very high volume premium giveaways, it is useful to reduce the assembly cost by shipping the flying toy to the user in an unassembled condition and having the user assemble the toy.

I claim:

1. A throwing toy comprising a substantially rigid ring-like structure, said structure including:

a) concentric inner and outer rings and a fastener for maintaining said rings in an assembled position, said ring-like structure having an axial length and an opening for receiving airflow when said toy is launched through the air; and b) a trailing portion which comprises a collapsed, cylindrical tail made of thin, sheet-like material and being collapsible under its own weight, said tail having a length that is at least two times that of the axial length of said ring-like structure, said cylindrical tail having a front margin, said front margin being retained between said concentric inner and outer rings to retain said cylindrical tail to said ring-like structure.

2. A throwing toy according to claim 1 wherein said inner ring has a generally cylindrical outer surface and said outer ring has a generally cylindrical inner surface, said surfaces being in face to face relation and wherein said front margin of said tail is retained between said surfaces when the inner and outer rings are in the assembled position.

3. A throwing toy according to claim 2, wherein said outer surface of said inner ring has a series of undulations, and wherein said inner surface of said outer ring has a series of undulations, said undulations on said surfaces mating, said front margin of said tail being located in the region of said undulations, said undulations gripping said front margin and retaining said tail.

4. A throwing toy according to claim 3, wherein said outer ring has a front edge, said front edge being formed by an acurate turn in said ring terminating in and annular hook, said arcuate turn forming a cavity, said inner ring having a front edge received in said cavity, said inner ring having a retaining groove for receiving said hook, said hook entering said retaining groove upon assembly to retain said inner and outer rings in concentric relation.

5. A process of preparing a readily packagable throwing toy comprising:

a) providing a forward portion comprising a substantially ring-like structure having air inner ring and an outer ring, both rings having an opening for receiving airflow and an axial length;

b) providing a trailing portion comprising a collapsible cylindrical tail made of a thin, sheet-like material and having a length of at least about two times the axial length of said ring-like structure said trailing portion having a front margin; and c) placing the front margin of said trailing portion between said inner and out rings, and assembling said inner and outer rings together to secure said trailing portion to said forward portion to form an aerodynamic throwing toy.

6. The process of claim 5, wherein said ring-like structure comprises a rigid, high density plastic ring.

7. The process of claim 6, wherein said high density plastic ring comprises polyvinyl chloride, high density polyethylene or high density polypropylene.

8. The process of claim 5, wherein said cylindrical tail comprises a low density plastic material.

9. The process of claim 5, wherein said trailing portion is secured to said forward portion via adhesive.

* * * * *